US006997321B2

(12) United States Patent
Young

(10) Patent No.: US 6,997,321 B2
(45) Date of Patent: Feb. 14, 2006

(54) MULTIPLE-COLOR COMBINATION LIPSTICK AND COSMETIC CASE

(76) Inventor: Jean Young, 2F.,No. 52. Tien Shui Road, Taipei City (TW)

( * ) Notice: Subject to any disclaimer, the term of this patent is extended or adjusted under 35 U.S.C. 154(b) by 47 days.

(21) Appl. No.: 10/610,764

(22) Filed: Jul. 2, 2003

(65) Prior Publication Data

US 2005/0000850 A1 Jan. 6, 2005

(51) Int. Cl.
*A45D 33/02* (2006.01)
*A45D 33/22* (2006.01)

(52) U.S. Cl. ..... 206/581; 132/294; 132/301; 132/313; 132/315; 132/317; 206/823

(58) Field of Classification Search ..... 132/294, 132/301, 313, 314, 315, 317; 206/581, 823; 401/129
See application file for complete search history.

(56) References Cited

U.S. PATENT DOCUMENTS

| | | | | | |
|---|---|---|---|---|---|
| 1,872,864 | A | * | 8/1932 | Yarcho | 206/430 |
| 2,209,781 | A | * | 7/1940 | Lewis | 190/109 |
| 2,721,561 | A | * | 10/1955 | Dyche | 401/129 |
| 3,426,768 | A | * | 2/1969 | Vardaros | 132/315 |
| 4,858,765 | A | * | 8/1989 | Nakamura et al. | 206/581 |
| 5,107,984 | A | * | 4/1992 | Welschoff | 206/751 |
| 5,211,302 | A | * | 5/1993 | Tiramani | 220/4.25 |

* cited by examiner

*Primary Examiner*—John A. Ricci
(74) *Attorney, Agent, or Firm*—Troxell Law Office, PLLC

(57) ABSTRACT

A multiple-color combination lipstick and cosmetic case, including a cover unit and a base. The base provides a plurality of non-opened storage spaces or storage units that are divided by partition boards, wherein lipsticks, eyeshadows and other cosmetic materials in various colors are contained. Each storage space and storage units respectively has an opening that is sealed by a brush assembly. The brush is used to simultanously open a desired container and take up a desired cosmetic material. The multiple-color lipstick or eyeshadow container has a compact size for easy portability and easy access.

8 Claims, 5 Drawing Sheets

MULTIPLE-COLOR COMBINATION LIPSTICK AND COSMETIC CASE

BACKGROUND OF THE INVENTION

Most lipstick cases available on the market are generally packed in single cases or tubes containing single-colored lipstick or cosmetic material. There are limitations, however, on the filling, storage, carrying and use of the market available lipsticks in liquid or paste form, with only one color of lipstick contained in a single container. A cosmetics user generally owns several lipsticks in different colors in solid and liquid forms to go with different dresses and moods for different occasions. Though individual package of lipstick has a small size and easy to carry around, a user has to carry several packages of lipstick and cosmetic materials and utensils in various colors. Though such inconvenience can be improved by carrying a large case containing several divided compartments of containers to contain different colors of lipsticks or other cosmetic materials, the large case is too bulky and inconvenient to carry. Furthermore, the conventional lipstick case could not contain liquid and paste form of lipsticks.

Available on the market are two-ended type of lipstick container or multiple layers of containers or other types of lipstick container combinations, but those containers provide only completely opened and stacked containers. They could not contain liquid or paste form of lipsticks. They could not contain multiple colors of liquid and paste form of lipsticks in the accommodating space of a regular lipstick case. It is desirable to make improvement on the above shortcomings.

SUMMARY OF THE INVENTION

The present invention of multiple-color combination lipstick and cosmetic container comprises:

A base, providing divided storage spaces or a combination of storage units, on top of each storage space and storage unit is an opening;

A specified number of brushes to match the number of storage spaces and storage nits, assembled to seal the openings of the storage spaces, with brush heads constantly inserted in the storage spaces;

A cover unit to match the base;

The cover unit and the base are assembled to form a container that can be opened and closed, the base providing a plurality of storage spaces respectively filled with non-solid cosmetic materials in different colors, to form a cosmetic case containing multiple colors of non-solid cosmetic materials for ready use within limited measurements.

DETAILED DESCRIPTION OF PREFERRED EMBODIMENTS

Figure 1:
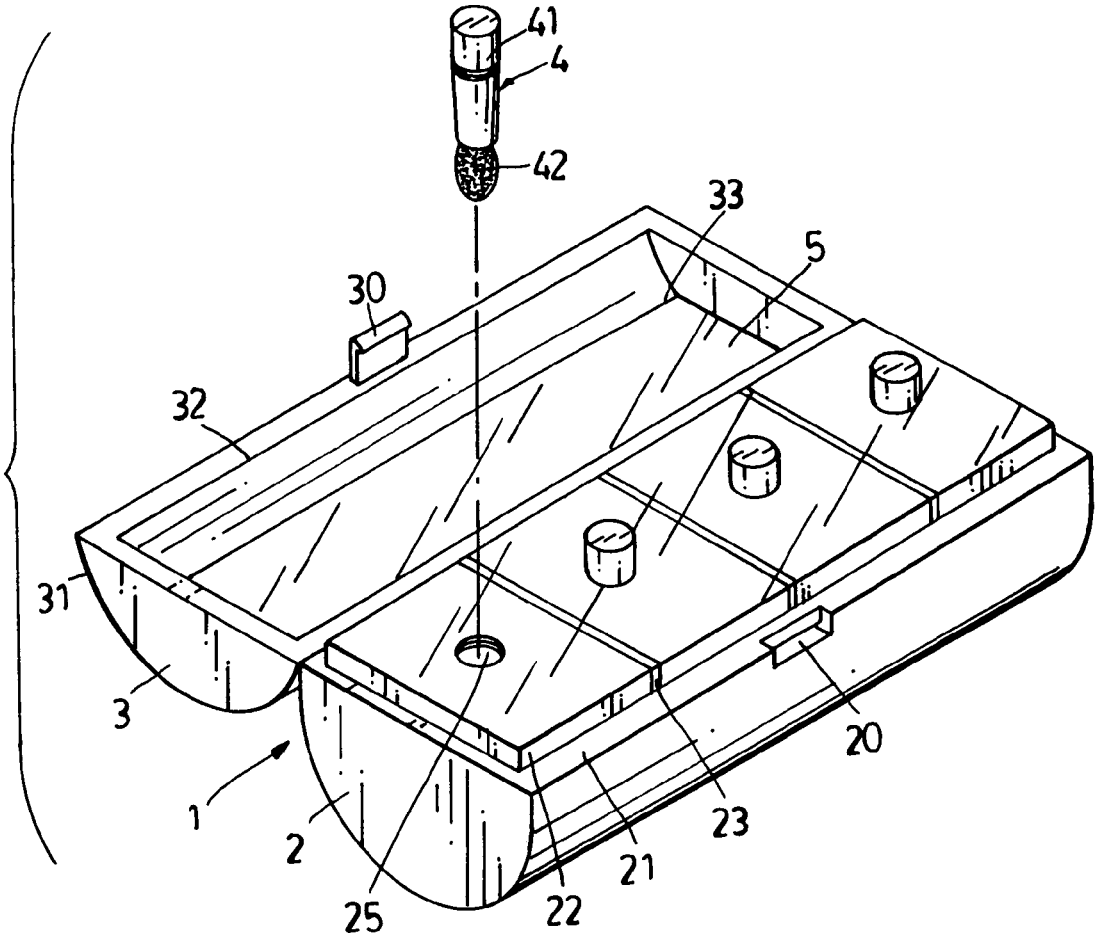
FIG. 1 is an exploded view of a first embodiment of the invention.
Figure 2:
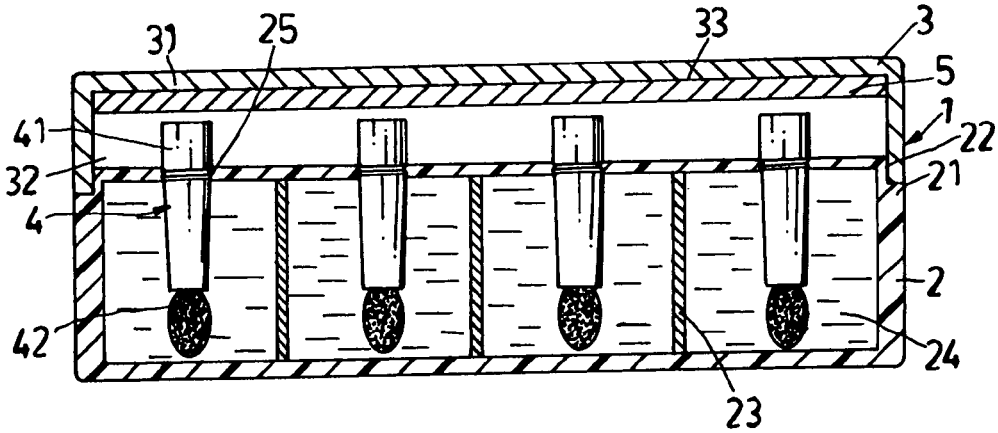
FIG. 2 is a sectional assembled view of the first embodiment of the invention.

As illustrated in the embodiment in FIGS. 1 and 2, a container 1 comprises basically a base 2 and a cover 3 joined as one unit (by hinging or fastening process), to contain lipsticks, eyeshadows or other cosmetics in multiple colors, wherein The base 2, shown in FIGS. 1 and 2, including a box shaped container unit 21, is made of molded plastics or extruded plastics or other lightweight strips. The box container unit 21 is selectively formed to have a section in a "D" shape, as shown in FIG. 1, providing an interior hollow space. The box container unit 21 is preferably designed to have a shorter length than and the same measurements as the regular lipstick container available on the market. Importantly, it is to be understood that other lengths and sectional areas are also acceptable. The surface of the box container unit 21 is selectively designed to show all sorts of decorative patterns or grains, and coated directly with paintwork to enhance beautiful appearance.

The box container unit 21 on the base 2 provides a hollow interior space. The space is partitioned by a specified number of partitioners 23, dividing the interior hollow space of the box container unit 21 into a specified number of containing spaces 24, as shown in FIG. 2. On the upper side of each sealed containing space 24 is an opening 25, thereby lipsticks, eyeshadows or other cosmetics in liquid or paste form and in multiple colors are filled in respectively into the containing spaces 24, as shown in FIGS. 1 and 2.

The base 2 is optionally formed to include various shapes of container units, preferably made to have a transparent containing unit 31, thereby permitting obvious observation of the colors and remaining amounts of cosmetics contained in the containing spaces 24. However, it is to be understood that the aforementioned formation of the base 2 shall not be limited by the colors and shapes of the cosmetics.

The cover 3 is formed to have a hollow, interior, recessed space of container unit 31, with an opening 32 on the container unit 31 corresponding to the cover unit at a neck unit 22 on top of the base 2. Inside the space of the cover top 33 in the hollow containing space is fixedly installed (in a gluing, insertion, fastening or other joining process) a mirror-like reflector 5 serving as a mirror. The cover unit 3 has a fastener piece 30 matching a fastener unit 20 on the base 2 for securing purpose.

With the foregoing design, the present invention provides a plurality of sealed container spaces 24 inside a small space, thereby liquid or paste forms of lipsticks, eyeshadows and cosmetic tools in multiple colors are filled therein to facilitate carrying and ready use. To use the cosmetics, the user takes out the container 1 from her handbag and opens it. Knowing the color of the cosmetics contained in each container space 24 through the transparency of the container unit 1, the user can immediately take out a brush 4 for a particular color of cosmetics out of the opening 25, a brush end 42 of the brush 4 now moistened with the particular color of cosmetics (lipstick) for ready application, or optionally with the aid of the mirror-like reflector 5 inside the cover unit 3. After use, the user just inserts the brush 4 again into the opening 25 on the container space 24 and cover the cover unit 3 onto the base 2 for convenient carrying purpose.

Figure 3:
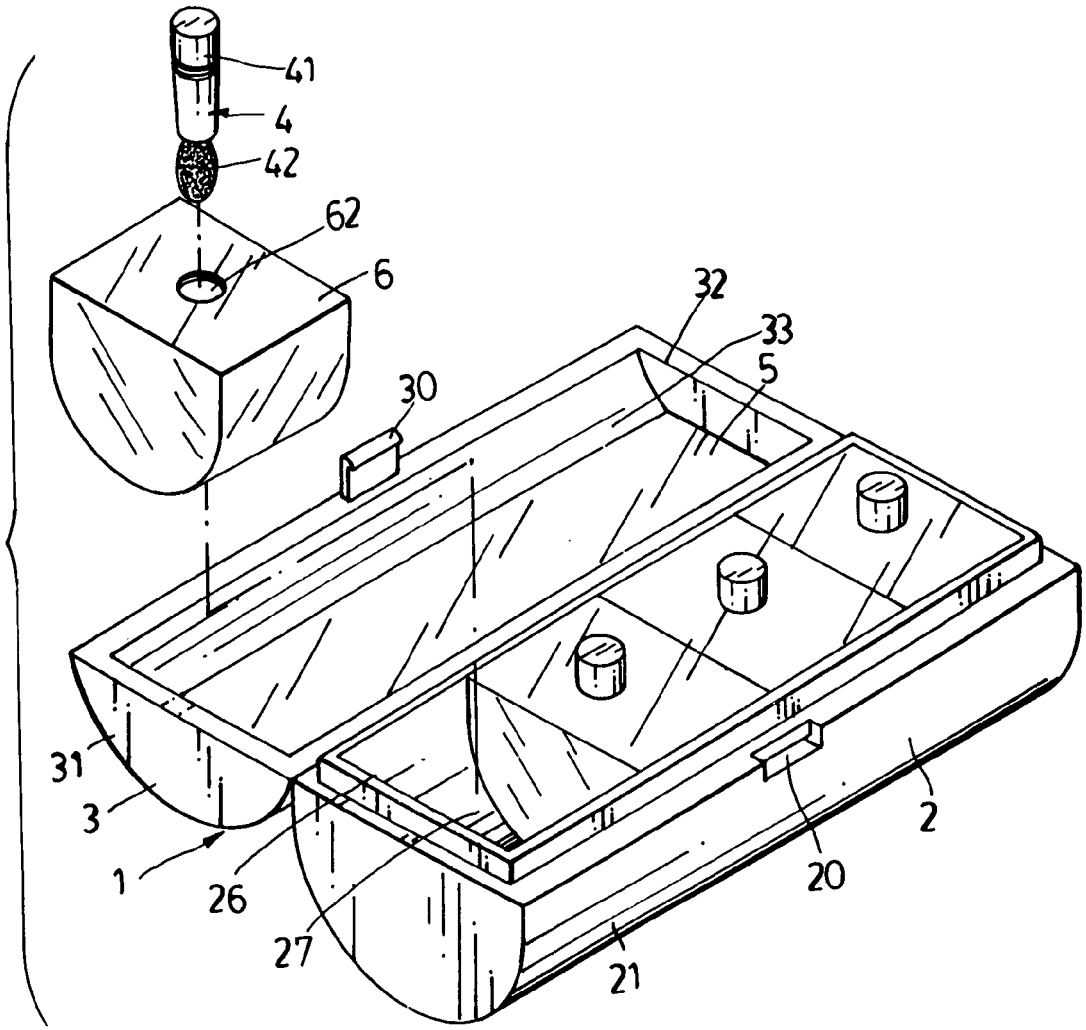
FIG. 3 is an exploded view of a second embodiment of the invention.
Figure 4:
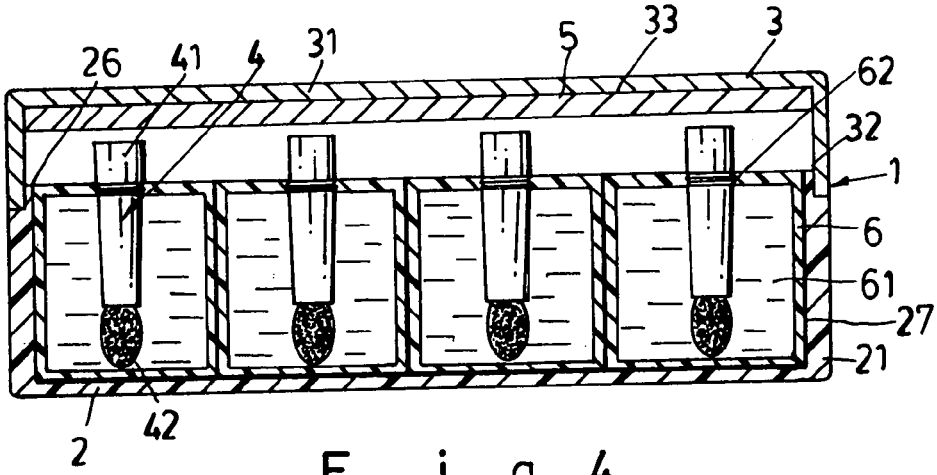
FIG. 4 is a sectional assembled view of the second embodiment of the invention.

The structure of the present invention may be modified without departing from the spirit and scope of its original design to satisfy the same functional requirements. FIGS. 3 and 4 illustrate another embodiment of the present invention of the container 1 comprising the same base 2 and the cover unit 3, wherein:

The base 2 includes a box container unit 21 having a hollow interior space and a "D-shaped" section as in FIG. 3. The container unit 21 provides a recessed combination space 27 having an upper opening 26. Inside the combination space 27 is arranged a specified number of container units 6, as shown in FIGS. 3 and 4, permitting convenience and selection for selectable replacement or combination.

FIGS. 3 and 4 illustrate a specified number of container units 6, preferably transparent and shaped to match the shape of the combination space of the container unit 21. The container unit 6 provides a hollow container space 61. On an upper side of each container space 61 is an opening 62. Inside these sealed container units 6 and container spaces 61 are respectively filled with multiple-colored lipsticks, eyeshadows or other cosmetics in liquid or paste form.

The brushes 4, having an equivalent number to the container spaces 61, are fixed (selectively by screwing, insertion or otherwise) to brush rods 41, aligned with the openings 62 of the container spaces 61, so the openings 62 are sealed by the brush rods 41 of the brushes 4, while the brush heads 42 of the brushes 4 are constantly inserted in the container spaces 24 and wetted by the cosmetics contained therein.

The cover unit 3 has a formation of storage unit 31 with a hollow space. An opening 32 of the storage unit 31 matches a cover unit of the base 2. The cubic measurements of the recessed hollow space of the storage unit 31 serve to accommodate the brushes 4 installed in the container unit 6 the inside space of the cover top 33 is fixed (by gluing, insertion or other joining process) with a mirror-like reflector 5 functioning as a mirror.

The foregoing structural design has the same features of the above embodiment, including the capability of containing lipsticks, eyeshadows and other cosmetics and cosmetic utensils in multiple colors and in liquid or paste form in compacted cubic measurements, convenient ready use and portability, and easy selection of various colors of cosmetics.

Figure 5:
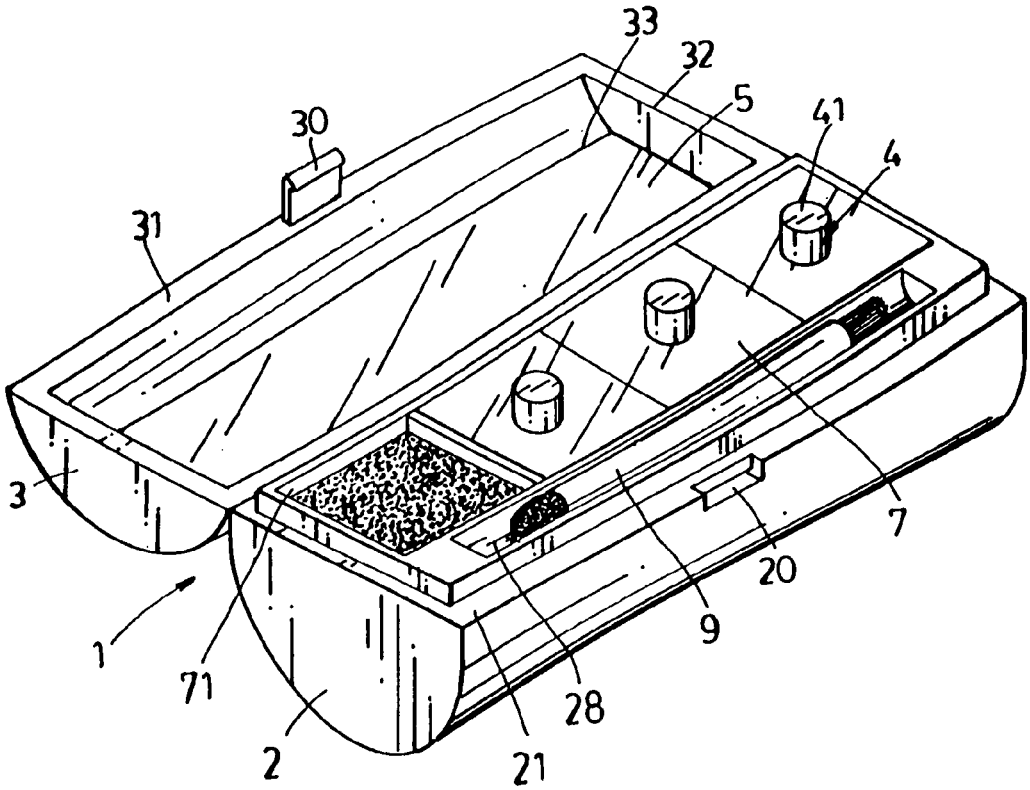
FIG. 5 is a perspective assembled view of a third embodiment of the invention.

FIG. 5 illustrates another embodiment of the present invention, comprising the same base 2 and the cover unit 3 combined to form a container 1, the cover unit 2 and the base 3 are preferably so combined but not limited to face opposite each other. The snap piece 30 on the cover unit 3 is fastened and secured onto the snap unit 20 on the base 2, wherein The base 2 includes a hollow case container unit 21. The container unit 21 provides a specified number of sealed storage areas 7 and non-sealed storage areas 71, respectively providing spaces to contain lipsticks, eyeshadows or other cosmetics in liquid or paste form. The base 2 has at least one horizontal recess 28 located at neighboring storage areas 7, 71, providing spaces to accommodate brushes 9 to apply solid forms of cosmetics. (Shown in FIG. 5)

The sealed storage area 7 is selectively designed in the same formation of the foregoing container unit 6, or the non-open space inside the storage unit 21 can be divided by partitioning boards 23 into a specified number of sealed container spaces 24 serving as the sealed storage area 7, with the installation of openings 70 and brushes 4 assembled for sealing and access purposes. As for the non-sealed storage area 71, the storage unit 21 provides an open space that is divided by partition boards 23 into a plurality of non-sealed container spaces 24 that serve as the non-sealed storage area 71, or, the foregoing storage unit 6 having non-sealed upper ends is selectively used to sere as the non-sealed storage area 71.

Figure 6:
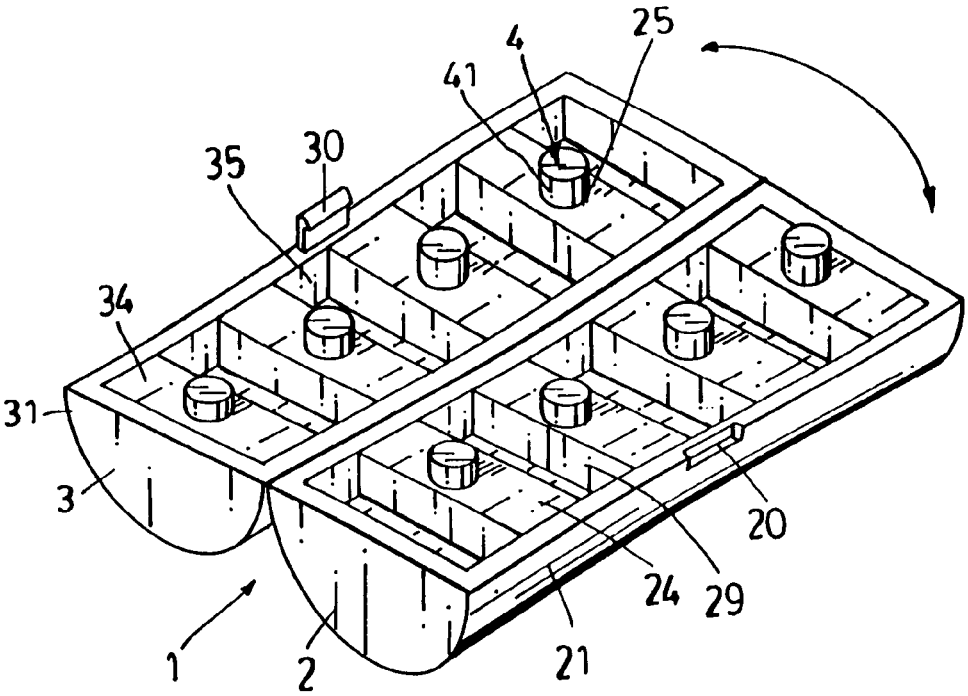
FIG. 6 is a perspective assembled view of a fourth embodiment of the invention.

FIG. 6 illustrates another embodiment of the present invention, comprising the same base 2 and the cover unit 3 combined as a container 1, wherein, the base 2 and the cover unit 3 are designed to have the same hollow case storage unit, providing a plurality of sealed container spaces 24, 34, between two neighboring container spaces 24 or 34 is a recessed space 29, 35. The recessed space 29, 35 in the container space 24 of the base 2 and the cover unit 3 are arranged to complement each other, where by means of the recessed space 29, 35, when the base 2 and the cover unit 3 are snapped and fastened together, the brush 4 protruding out of the opening 25 of the container space 24, 34 has an accommodating space.

Figure 7:
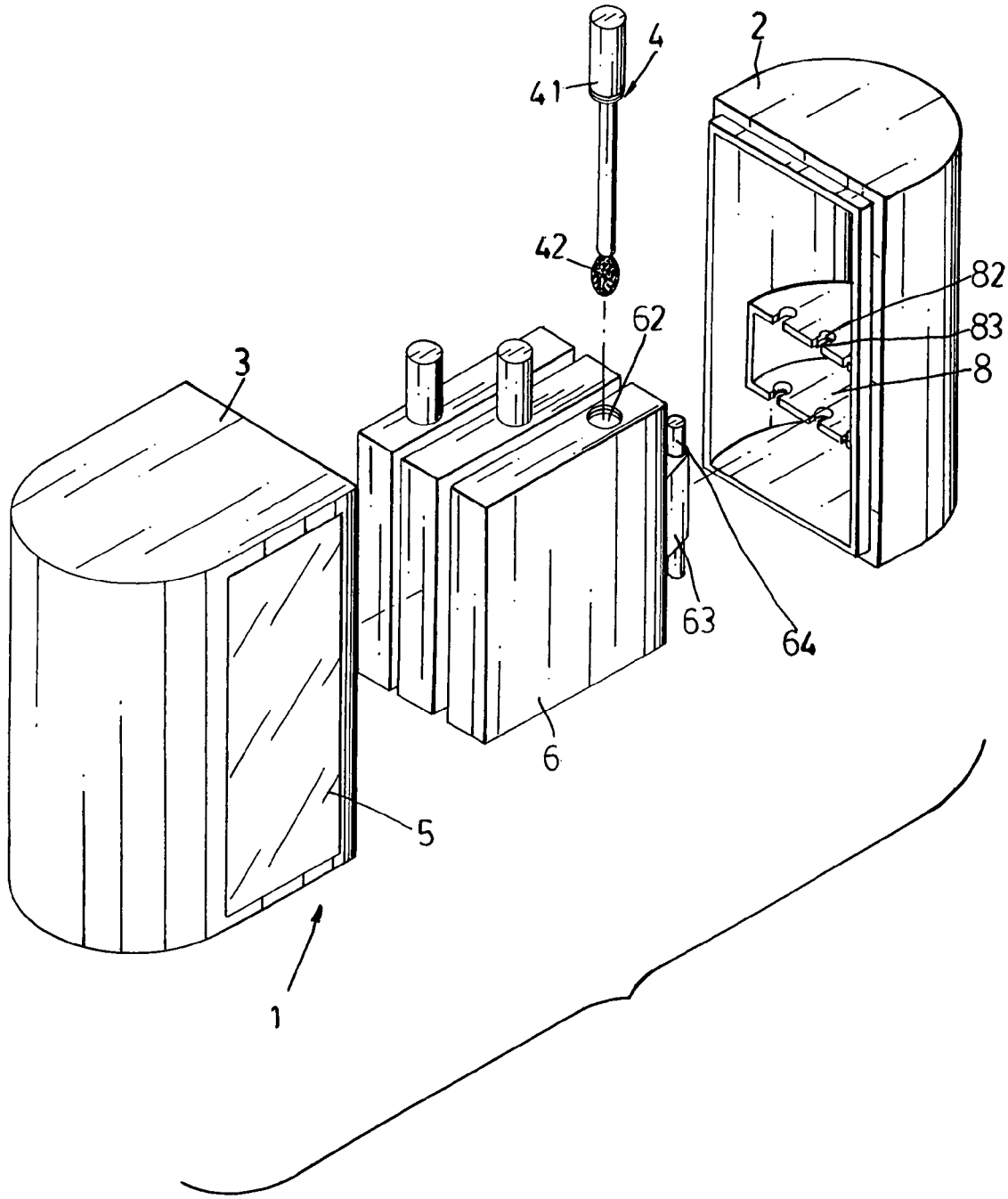
FIG. 7 is an exploded view of a fifth embodiment of the invention.
Figure 8:
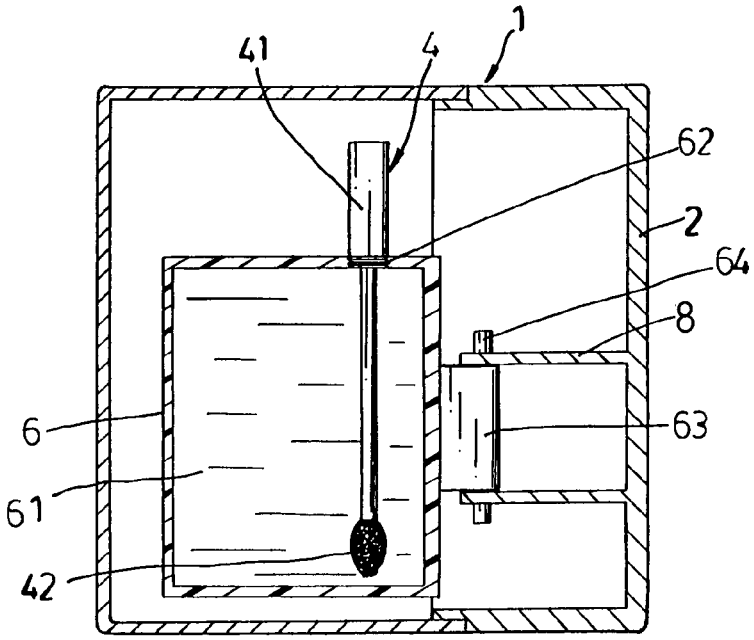
FIG. 8 is a longitudinally section view of the fifth embodiment of the invention.
Figure 9:
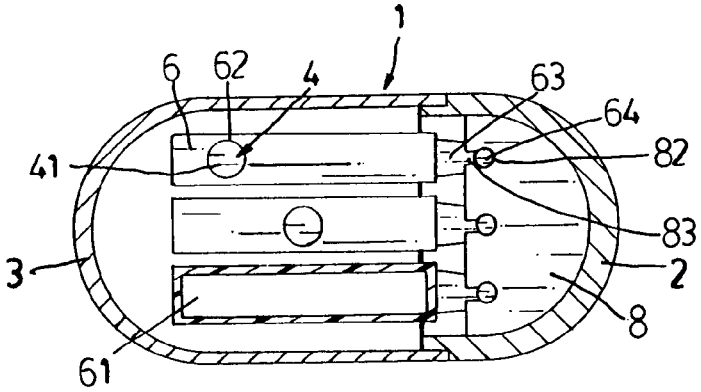
FIG. 9 is a horizontally section view of the fifth embodiment of the invention.
Figure 10:
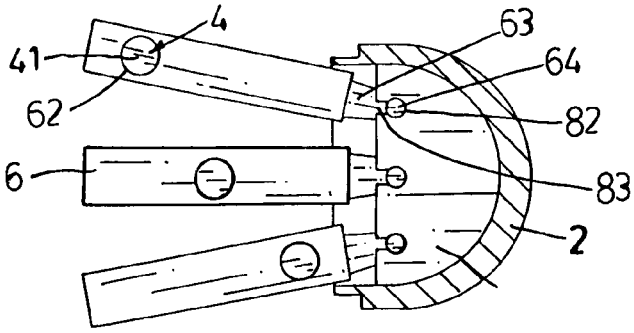
FIG. 10 is a schematic view of the fifth embodiment of the invention when extended for use.

FIGS. 7 through 10 illustrate other embodiments of the present invention. The container 1 consists of the base 2 and the cover unit 3. The cover unit 3 and the base 2 are preferably designed but not limited to oppose each other, where the storage unit 6 serves to store lipsticks, eyeshadows or other cosmetics and cosmetic utensils in multiple colors and in liquid or paste form, wherein The base 2, as shown in FIG. 7, has a hollow box-shaped storage unit 21. Inside the storage unit 21 is contained a fastener unit 8, permitting axial assembly and rotation for the storage unit 6. On one side of the fastener unit 8 are a plurality of shaft fastening holes 82, each fastening hole 82 is provided with an opening 83 to facilitate convenient fastening and disengaging functions.

The diameter of the shaft fastening hole 82 on the fastener unit 8 is preferably no less than the diameter of the shaft post 64 of the joining member 63, and slightly larger than the diameter of the shaft post 64 of the joining member 63. Preferably, the diameter of the opening 83 of the shaft fastening hole 82 is no larger than the diameter of the shaft post 84 of the joining member 83, to the extent that the shaft post 64 is pressed by a moderate force to pass through the opening 83 and be fastened in the shaft fastening hole 82.

The plurality of storage units 6 provide hollow storage spaces 61. On the upper side of each sealed storage space 61 is an opening 62. In the sealed storage units 6 and the storage spaces 61 are filled lipsticks, eyeshadows and other cosmetics in different colors and in liquid or past form. On the end side of the storage unit 6 are joining units 63. Extending from the joining units 63 are shaft posts 64. Thereby the shaft posts 64 of the joining units 63 are fastened and secured respectively in the shaft fastening holes 82 of the fastener unit 8, but capable of rotating.

The storage unit 6 is selectively made in a variety of different shapes and preferably in the formation of a flattened container, to facilitate arrangement. Meanwhile, the storage unit 6 is preferably made to have a transparent casing, so as to directly show the colors and levels of cosmetic materials contained in the storage space 61, and facilitate easy access, ready use and necessary replenishment. Of course, the formation of the storage unit 6 is not limited to the above in terms of its color and shape. In other words, it can be made to have semi-transparent casing or different colors to match the cosmetics contained therein.

The storage units 6 have a same number of cosmetic brushes 4, with matching brush rods 41 fixed onto the openings 62 of the storage units 6 (by gluing, fastening or other joining process), so the openings 62 are sealed by the brush rods 41 of the cosmetic brushes 4, while the brush heads 42 of the cosmetic brush 4 are inserted in the storage spaces 61 of the storage unit 6 and wettened by the liquid cosmetic materials contained therein.

The cover unit 3 is a hollow storage body. The Opening 32 of the storage body matches the corresponding cover unit on the neck 22 on top of the base 2. At an appropriate location on the outside of the cover unit 3 is selectively fixed by a mirror-like reflector 5 functioning as a mirror.

The structural design of space in the foregoing embodiment of the invention provides a multi-color cosmetic container like the foregoing embodiments. With the adoption of the flattened storage unit 4, the joining member 63 of each storage unit 6 is directly fastened in the shaft fastening hole 82 of the fastener unit 8 on the base 2, to form a combination of arrangement of a plurality of storage units 6 like book pages (shown in FIGS. 8 through 10). Different colors of liquid or past form of lipsticks, eyeshadows or cosmetic utensils are filled respectively in the storage spaces 61 of the storage unit 6 for easy portability and convenient access. To facilitate easy access to the cosmetic brushes 4, the storage units 4 are provided with the characteristic of rotating shafts for short-range rotation and extending of the storage units 6 (shown in FIG. 10) to facilitate convenient access to the cosmetic brushes 4, wetted with desired cosmetics (lipsticks) at the openings 62 of the storage unit 6.

What is claimed is:

1. A multiple-color combination lipstick and cosmetic case, comprising:

a base having a plurality of sealed storage spaces containing non-solid multiple-color cosmetic and having openings on a top side thereof;

a plurality of brushes sealing the openings on the storage space and having brush heads inserted inside the storage spaces; and a cover unit matching the base, wherein the sealed storage spaces provided by the base are non-open storage units having hollow spaces, the spaces being divided by partition boards longitudinally to form a plurality of storage spaces.

2. The multiple-color combination lipstick and cosmetic case of claim 1, wherein the sealed storage spaces provided by the base are single-unit storage units, arranged in combination in a non-sealed recessed space provided by the storage unit, for ready replacement or combination of storage units.

3. The multiple-color combination lipstick and cosmetic case of claim 1, wherein a reflector, such as a mirror, is located on the cover unit.

4. A multiple-color combination lipstick and cosmetic case comprising:

a) a base having a plurality of sealed storage spaces containing non-solid multiple-color cosmetics, each of the plurality of sealed storage spaces having an opening on a top thereof, the base having a D-shaped cross-section;

b) a plurality of brushes having brush heads inserted into the plurality of sealed storage spaces, one of the plurality of brushes is removably inserted into and sealing each opening of the plurality of sealed storage spaces; and c) a cover unit matching the base.

5. The multiple-color combination lipstick and cosmetic case according to claim 4, wherein each of the plurality of sealed storage spaces is a single-unit storage unit, a plurality of single-unit storage units are removably inserted into a hollow interior of the base.

6. The multiple-color combination lipstick and cosmetic case according to claim 4, wherein the top of each of the plurality of sealed storage spaces aligning with a top of the base.

7. The multiple-color combination lipstick and cosmetic case according to claim 4, wherein a reflector is located on an interior of the cover unit.

8. The multiple-color combination lipstick and cosmetic case according to claim 7, wherein the reflector is a mirror.

* * * * *